United States Patent [19]

Schuurmans

[11] 3,995,585

[45] Dec. 7, 1976

[54] LIQUID APPLICATION-DEVICE

[75] Inventor: Petrus J. G. Schuurmans, Venlo-West, Netherlands

[73] Assignee: Oce-van der Grinten N.V., Venlo, Netherlands

[22] Filed: June 17, 1975

[21] Appl. No.: 587,538

[30] Foreign Application Priority Data

June 27, 1974 Netherlands ..... 7408646

[52] U.S. Cl. ..... 118/204; 118/262; 354/318

[51] Int. Cl.[2] ..... B05C 1/08

[58] Field of Search ..... 118/203, 204, 262, 249; 354/318; 101/364, 157, 366

[56] References Cited

UNITED STATES PATENTS

| | | | |
|---|---|---|---|
| 2,102,984 | 12/1937 | Vonhofe | 118/204 |
| 2,887,050 | 5/1959 | Moser et al. | 101/364 |

*Primary Examiner*—John P. McIntosh
*Attorney, Agent, or Firm*—Albert C. Johnston

[57] ABSTRACT

A device which is useful in development of diazotype paper said device comprising a liquid application roller, a dosing roller cooperating with it and one or more pressing organs to bring the diazotype material into contact with the application roller. In order to reduce liquid transport via the extremities of the rollers toward the pressing organs, the dosing roller is provided with limiting elements which are installed at the exhaust side of the dosing roller near the nip between this roller and the application roller and each limiting element consists of at least five plates, installed perpendicularly on the shaft of the dosing roller of which plates one side is closely adjacent to the cylinder surface of the dosing roller. The limiting elements transport superfluous liquid from said nip between the rollers toward the liquid reservoir and thus they inhibit the liquid transport toward the pressing organs which would wet the rear side of the diazotype material.

7 Claims, 4 Drawing Figures

LIQUID APPLICATION-DEVICE

This invention relates to a device for the application of a layer of liquid to a sheetlike material, which device is provided with a liquid application roller, a dosing roller cooperating with it, limiting elements near the extremities of the rollers and one or more pressing organs to bring the sheetlike material into contact with the application roller. By a sheetlike material either a sheet or a web of the material is meant.

When a layer of liquid is applied to a sheetlike material, it is often desirable to dose a controlled quantity of the liquid in a uniform layer. The dosing and homogeneous distribution are especially critical when for instance a lightsensitive material exposed imagewise, such as diazotype paper, has to be moistened unilaterally with a minimum quantity of developing liquid. As a matter of fact diazotype paper is developed by, preferably unilaterally, applying liquid in a quantity that is smaller than about 4 g/m$^2$, because then the material need not be dried by heating or by the supply of air. Further, the application of a layer of liquid to a sheetlike material makes it desirable that the quantity of liquid that is applied per unity of surface be independent of the speed of transport. This is especially important upon application for the development of lightsensitive materials, because in many cases use is made thereby of a combination of an exposing and a developing apparatus which both work with the same speed and with which the exposure time of the lightsensitive material is regulated by means of the speed of transport through the combination.

Devices with which always the same quantity of liquid can be applied per unity of surface of the sheetlike material, within certain limits independent of the speed, are known.

The Dutch Pat. application No. 72 07 099 published Nov. 28, 1973, describes a device which is provided with a liquid application roller, a dosing roller cooperating with it and a pressing organ for the sheetlike material. The dosing roller is provided with a structured surface and is partially immersed into a developing liquid. The liquid application roller has a smooth and elastic surface and cooperates with the dosing roller so that the surfaces of the rollers move in the same direction at the side where they touch each other. The dosing roller transports the liquid into the nip between the rollers and doses a layer of liquid onto the application roller, the thickness of which layer is mainly defined by the size of the openings which are formed between the structured surface of the dosing roller and the smooth surface of the application roller.

By changing the speed of the rollers only the supply speed of the liquid is modified, but not the thickness of the layer of liquid on the application roller. From the application roller the liquid is transferred to the sheetlike material by leading this material along the application roller and by pressing it against this roller during the passage, by means of the pressing organ. The pressing organ is provided with U-shaped notches which are perpendicular to the touching line of the pressing organ with the application roller, in order to prevent the formation of a liquid meniscus between the pressing organ and the application roller, and thus to reduce the wettening of the leading part of the rear side of the sheetlike material. Such a device does not make it possible to prevent the pressing organ from being wetted at moments when no sheetlike material is passing. As far as this wettening is caused by the liquid film on the roller, it is only small, but an extra liquid transport takes place via the extremities of the rollers. This liquid transport is so considerable that the openings between the application roller and the pressing organ are completely filled with liquid if during some tens of seconds no sheetlike material is supplied.

Means have already been proposed that reduce the liquid transport via the extremities of the rollers. U.S. Pat. No. 3,667,428 describes a developing device for the development of latent charge images, whereby the liquid application roller is provided with limiting elements in the form of scraping plates which are installed in parallel to the shaft of the roller near the extremities. However, these plates have the disadvantage that they can only be used when the application roller as described has a profiled shape. A profiled application roller cannot be used when a minimum quantity of liquid has to be distributed homogeneously over a sheetlike material such as paper. Besides, the developing device according to U.S. Pat. No. 3,667,428 is not intended for use.

When plates according to the last-mentioned patent are used on a smooth or slightly roughened application roller, an accumulation of liquid behind the plates will occur and as a result of this an uneven layer of liquid on the application roller near the edges of these plates.

The object of the invention is to eliminate this disadvantage and to reduce the wettening of the rear side of the sheetlike material to a negligible level.

According to the invention that is attained, in that in a device, as mentioned in the beginning, the limiting elements are installed at the exhaust side of the dosing roller near the nip between this roller and the application roller, and each limiting element consists of at least five plates, installed perpendicularly on the shaft of the dosing roller, of which plates one side is closely adjacent to the cylinder surface of the dosing roller, and which plates are sufficiently spaced to prevent capillary obstruction of liquid transport between the plates.

Surprisingly it has appeared, that these plates reduce the wettening of the pressing organ to a minimum and reduce the wettening of the rear side of the sheetlike material to a negligible minimum.

Limiting elements consisting of four plates have hardly any effect. Limiting elements with five plates yield a favourable effect, which can be improved further by adding a sixth plate to the elements. A further extension of the number of plates is possible, but does not result in a further improvement of the effect.

The distance between the plates is not critical. However, it may not become lower than a minimum value, because then the capillary effect results in an obstruction of the liquid transport. The minimum distance required cannot be indicated exactly, as this is for instance dependent on the kind of the material of the plates and the kind of the liquid, but in most cases the required minimum distance is 1 mm. Although the favourable effect is not dependent on a maximum distance between the plates, it is not necessary to choose a distance which is higher than about 3 mm. Moreover, the rollers would then have to be lengthened unnecessarily.

Preferably in the device according to the invention sets of at least five plates are used, which sets form one whole; so a practical embodiment consists of a small block of which the surface adjacent to the surface of the cylinder of the dosing roller is provided with at least four grooves. In most cases the depth and width of the grooves must be at least 1 mm to prevent that the above-mentioned capillary effect dominates. The plates have their most favorable effect when they extend into the liquid meniscus which is formed by the liquid near the nip of the application roller and dosing roller.

As the excessive quantity of liquid is exhausted near the extremities of the rollers via the channels which are bordered by the grooves and the rotating surface of the dosing roller, this roller has a liquid-sucking effect which is the most favorable when the channels and thus also the plates extend over a distance of at least 1 cm in the direction of rotation over the surface of the dosing roller. In order to prevent that tracks of wear are made in the application roller, the plates are preferably mounted in such a way that they do not touch the application roller. Contact with the application roller does not disturb the favorable effect, but is not necessary either for the result desired. The plates and small blocks may consist of any material that is resistant against the liquid to be applied. Very suitable materials are metals, such as aluminum, thermoplastic plastics, such as nylon or polyvinyl chloride, and thermohardening plastics, such as phenylformaldehyde resins. With the device according to the invention the systems, known per se, of cooperating rollers can be used. With a system of cooperating rollers the thickness of the liquid on the application roller is determined by the opening between the application roller and the dosing roller. If exclusively smooth rollers are used, this opening can be adjusted by adjusting the width of the slit between the rollers. Preferably rolls are used which rest on each other, whereby a certain opening is obtained by selecting for one of the rollers a roller with a structured surface, such as a roughened surface or a surface with grooves. Devices for the application of a minimum quantity of developing liquid at one side of a lightsensitive material, such as diazotype paper, are preferably provided with a structured dosing roller and a smooth application roller, because in this type of device a structured application roller can cause a development according to the pattern of the application roller. The liquid can be applied to the rollers by means of a spraying device which sprays the liquid onto the dosing roller, or by mounting the dosing roller above a liquid reservoir in such a way that the dosing roller is partially situated below the level of the liquid to be applied.

The liquid can also be applied via an auxiliary roller. The pressing organ for the sheetlike material can for instance consist of a pressing blade, as described in Dutch Pat. application No. 72 07 099 or No. 73 01 622, but alternatively it is possible to use a roller which is grooved or structured in an other way.

The invention is further clarified by means of the accompanying drawings, in which.

Figure 2:
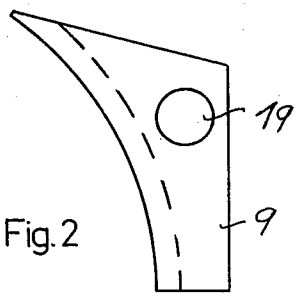
FIG. 2 is a side view of a limiting element, as applied in the device according to the invention.
Figure 3:
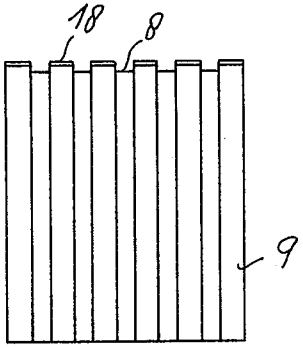
FIG. 3 is an elevational view of the same limitng element on the side thereof which is closely adjacent to the dosing roller.
Figure 1:
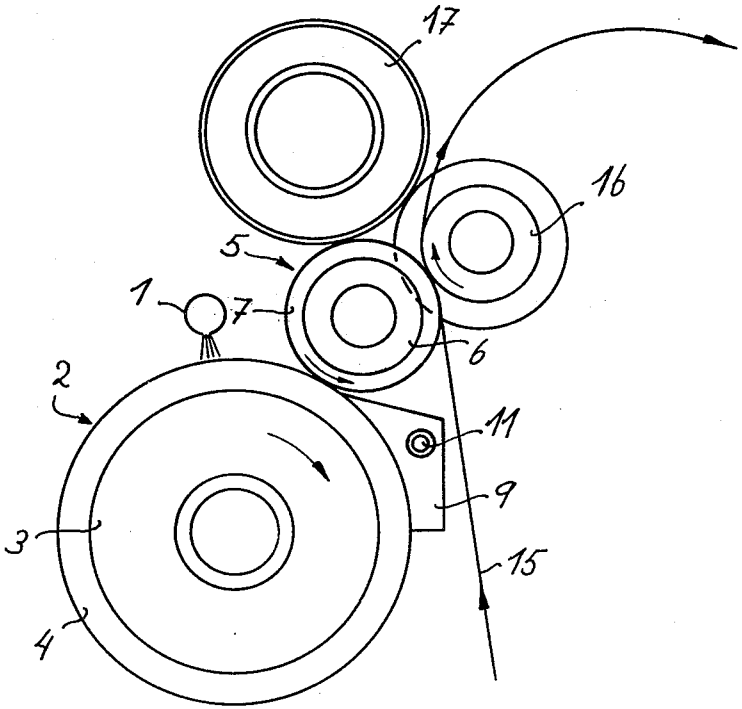
FIG. 1 is a side view of a device according to the invention.
Figure 4:
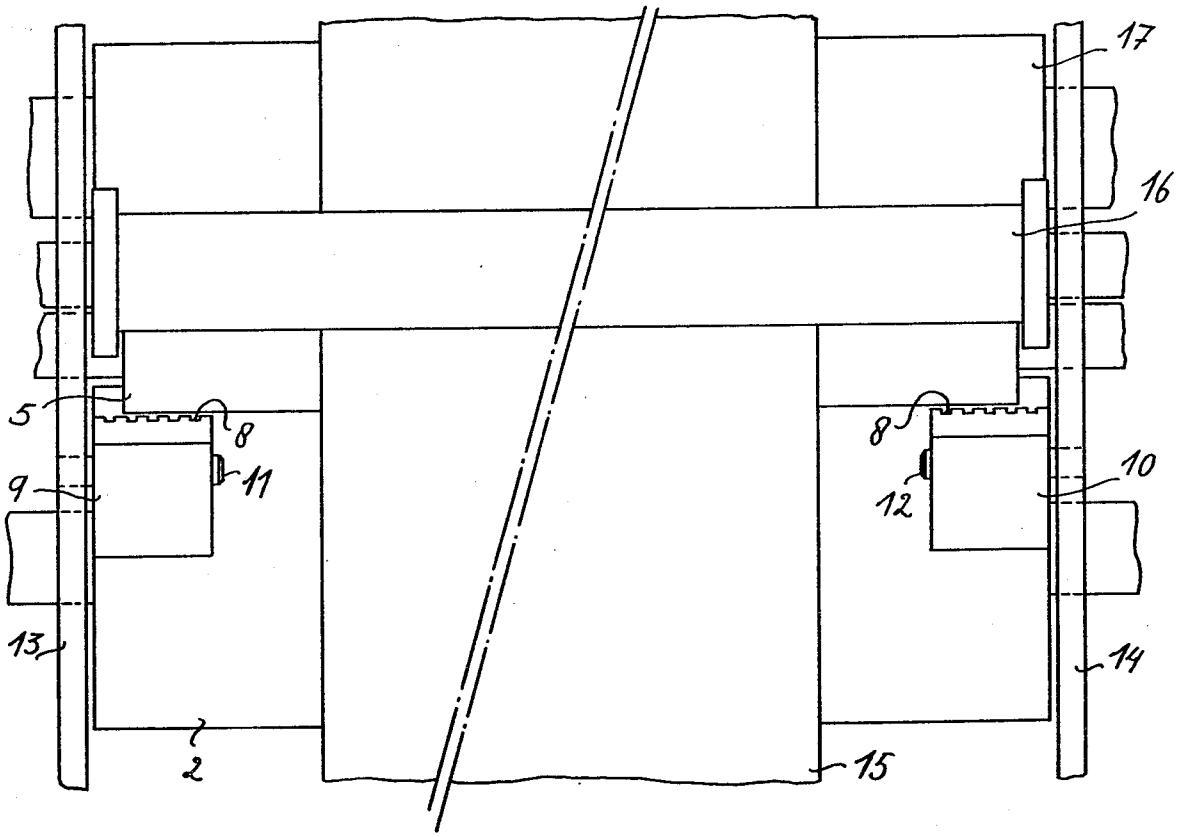
FIG. 4 is a front view of the device represented in FIG. 1.

With the device according to FIG. 1 and 4 liquid is sprayed onto dosing roller 2 by means of a perforated tube 1, which dosing roller consists of a metal core 3 which is covered with a plastic layer 4, of which the surface is grooved up to a depth of 20 $\mu$, and which rotates in the direction indicated by the arrow. The liquid is transferred to the application roller 5, consisting of a metal core 6 covered with a smooth rubber layer 7, via the nip between the rollers 2 and 5. Superfluous quantity of liquid at the edges of the rollers 2 and 5 is drained off via the channels 8 in the limiting elements 9 and 10 to a non-represented receiving tray below the dosing roller 2. The limiting elements 9 and 10 are mounted against the dosing roller 2 by means of the shafts 11 and 12 which are fixed to the side panels 13 and 14. The liquid layer on the application roller 5 is transferred to the sheetlike material 15, which is pressed against the application roller 5 by means of a metal pressing roller 16. The surface of the pressing roller 16 is provided with a non-represented structure. The sheetlike material 15, which passes between the rollers 5 and 16 in the direction represented by the arrows, is bent in the desired direction by the reversing roller 17. As represented in FIGS. 2 and 3, the plates of the limiting elements 9 and 10 are formed by the ribs 18 besides the grooves 8. The elements are provided with the perforation 19 which makes it possible to interchange the elements on the shafts 11 and 12 (represented in FIGS. 1 and 4).

In an alternative embodiment the perforation 19 of the limiting elements is replaced by a groove. This makes the position of the shafts 11 and 12 less critical, because the elements can move in a direction perpendicular on the dosing roller, and rest on this roller by their own weight.

I claim:

1. Device for the application of a liquid layer to a sheetlike material, which device comprises a liquid application roller, a dosing roller having a cylindrical surface cooperating with said application roller and rotatable with the latter through a nip between said rollers, elements near the extremities of said rollers for limiting the amount of liquid transportable there and one or more organs for pressing the sheetlike material into contact with the application roller, characterized in that said limiting elements are installed at said surface of the dosing roller at the downstream side of and near to said nip, and each of said limiting elements comprises at least five plates lying perpendicular to the axis of the dosing roller, said plates each having an edge thereof closely adjacent to said cylindrical surface and said plates being sufficiently spaced apart to prevent capillary obstruction of liquid transport between them.

2. Device according to claim 1, the distance between each two adjacent plates of said limiting elements being at least 1 mm.

3. Device according to claim 1, said plates being constituted by facial ribs of a block having at least four grooves formed and spaced apart in a face thereof to provide same ribs.

4. Device according to claim 3, said grooves each having a width and depth of at least 1 mm.

5. Device according to claim 1, each of said plates being held out of contact with said application roller yet in a position to extend into a liquid meniscus that forms at said nip.

6. Device according to claim 1, said plates extending over said surface of the dosing roller through a distance of at least 1 cm in the direction of rotation of said surface.

7. Device for the application of a liquid layer to a sheetlike material, which device comprises a liquid application roller, a dosing roller having a cylindrical surface cooperating with said application roller and rotatable with the latter through a nip between said rollers, elements near the extremities of said rollers for limiting the amount of liquid transportable there and one or more organs for pressing the sheetlike material into contact with the application roller, characterized in that said limiting elements are located at said surface of the dosing roller at the downstream side of and near to said nip, and each of said limiting elements comprises at least five plates lying perpendicular to the axis of the dosing roller, said plates each having an edge thereof closely adjacent to said cylindrical surface and said plates being sufficiently spaced apart to prevent capillary obstruction of liquid transport between them, the distance between each two adjacent plates of said limiting elements being at least 1 mm, said plates being constituted by facial ribs of a block having at least four grooves formed and spaced apart in a face thereof to provide said ribs, said grooves each having a width and depth of at least 1 mm, each of said plates being held out of contact with said application roller yet in a position to extend into a liquid meniscus that forms at said nip, said plates extending over said surface of the dosing roller through a distance of at least 1 cm in the direction of rotation of said surface.

* * * * *